US009816281B2

(12) United States Patent
Angelo

(10) Patent No.: US 9,816,281 B2
(45) Date of Patent: Nov. 14, 2017

(54) FOOTING REPLACEMENT

(71) Applicant: Art Angelo, Escondido, CA (US)

(72) Inventor: Art Angelo, Escondido, CA (US)

( * ) Notice: Subject to any disclaimer, the term of this patent is extended or adjusted under 35 U.S.C. 154(b) by 0 days.

(21) Appl. No.: 14/853,744

(22) Filed: Sep. 14, 2015

(65) Prior Publication Data

US 2016/0097209 A1 Apr. 7, 2016

Related U.S. Application Data

(60) Provisional application No. 62/059,391, filed on Oct. 3, 2014.

(51) Int. Cl.

| | |
|---|---|
| ***E04H 12/22*** | (2006.01) |
| ***E04G 23/02*** | (2006.01) |
| *E02D 27/00* | (2006.01) |

(52) U.S. Cl.

CPC ..... *E04G 23/0229* (2013.01); *E04H 12/2269* (2013.01); *E02D 27/00* (2013.01)

(58) Field of Classification Search

CPC . E04H 12/2269; E04H 12/2292; E02D 27/42; E02D 27/48

See application file for complete search history.

(56) References Cited

U.S. PATENT DOCUMENTS 4,306,821 A * 12/1981 Moore ..... E02D 5/64 405/211
4,644,722 A * 2/1987 Phillips ..... E04H 12/2292 52/170
4,972,642 A * 11/1990 Strobl, Jr. ..... E02D 27/42 52/165
5,573,354 A * 11/1996 Koch ..... E02D 5/60 405/216
5,873,207 A * 2/1999 Bertels ..... E01F 8/0023 52/250
7,921,616 B2 * 4/2011 Reyneveld ..... E02D 27/42 52/295
8,528,282 B1 * 9/2013 Hemphill ..... E04B 1/24 52/170
2002/0094239 A1 * 7/2002 Bradley ..... E02B 17/0026 405/216
2007/0056226 A1 * 3/2007 Angelo ..... E02D 27/48 52/169.9
2007/0056227 A1 * 3/2007 Angelo ..... E02D 27/48 52/169.9

(Continued)

FOREIGN PATENT DOCUMENTS

GB 1489518 A * 10/1977 ..... E02D 5/64

*Primary Examiner* — Elizabeth A Quast
(74) *Attorney, Agent, or Firm* — Clement Cheng

(57) ABSTRACT

A fabric formed footing has a column retainer assembly with a post socket and a post socket base. The column retainer assembly is a rigid structural member. A base plate is connected to the post socket. The base plate has a base plate underside opposing a base plate top surface. The base plate is connected to the post socket at the base plate top surface. A moment leg is connected to the base plate. The moment leg is connected to the base plate underside. The moment leg has a moment leg horizontal section, a moment leg vertical section, and a bend between the moment leg horizontal section and the moment leg vertical section. The moment leg vertical section is the portion of the moment leg that is connected to the base plate underside.

8 Claims, 7 Drawing Sheets

(56) References Cited

U.S. PATENT DOCUMENTS

2012/0324825 A1* 12/2012 Vrame ..... E04G 21/185
52/745.21
2013/0186034 A1* 7/2013 Angelo ..... E02D 27/48
52/741.15

* cited by examiner

FOOTING REPLACEMENT

The present application claims priority from and is a non-provisional of inventor Art Angelo's provisional application No. 62/059,391 entitled Poured In Place Foundation Footing, filed Oct. 10, 2014, the disclosure of which is incorporated herein by reference.

FIELD OF THE INVENTION

The present invention is in the field of foundation footing replacement systems that can be installed under a crawl space of a home without moving or lifting the home.

BACKGROUND OF THE INVENTION

This invention generally relates to a system for supporting buildings above ground surface, and is particularly directed to restraining the lateral movement of posts and piers under girders and building sections of crawl space homes. The present method of support is so designed as to effectively eliminate the consideration of ground tremors and contour, with a unique method of using fabric to contain poured in place concrete footings to prevent such conditions that may adversely affect the integrity and stabilization of vintage crawl space homes lacking any connection to its foundation stem wall.

Experience has taught that the weakest structural points of the crawl space home is the footings that settle with age. In order to attain adequate support, a footing must be poured in place with at least six square feet of actual surface area which never before could be achieved due to the confined crawl space leaving the most important component needed to strengthen and support the post holding the girder up missing and, thus, the lateral movement of the existing post can cause the home to collapse. Such lateral shifts among the posts can even cause these vintage homes to slide off their stem wall and cause serious damage or even total collapse. Historically, vibrations resulting in the lateral shifting of posts have caused these homes to collapse effecting possible injury to the home's occupants, and/or destruction of content property, and/or structural damage to the home itself.

It is, therefore, the general object of this invention to provide a poured in place concrete footing to support and brace existing or new posts that can be expediently installed. Another object of the invention is to provide the only known seismic retrofit for crawl space homes. Recently the City of San Francisco appointed a czar to oversee retrofitting older crawl space homes. Financial assistance to homeowners of fifty thousand dollars or more is available, but the FEMA states that they are at least four years away for coming up with a way to retrofit these homes. A further object of this invention is to provide the badly needed retrofit now. Another object of this invention is to save lives and be cost effective at the same time. Most homes can be retrofitted for less than half of what the City of San Francisco will pay out.

It is in object of this invention to provide a complete do-it-yourself foundation footing repair package. Unfortunately, currently there is no easy way for a homeowner to do foundation repair on their own. It is typically something that a homeowner hires an engineering company or contractor to handle. A further object of the invention is the provision of a device that will preclude lateral movement of the posts and girders against each other. An additional object of the invention is to provide a device that may be quickly and expediently installed on substantially any size crawl space home.

Other objects and advantages of this invention reside in the combination of elements, arrangement of parts, and features of construction, which will become more fully apparent as this description proceeds.

SUMMARY OF THE INVENTION

Accordingly, the present invention has been developed with a view toward saving homes and lives during a large seismic event implementing a footing support and bracing system that will secure wood or metal post to the ground by sheer weight and sliding resistance. The present invention enables both skilled and semi-skilled workers to secure, render level, and brace and support the posts and girders. Such an inventive footing support constrains the posts from lateral and unparalled movement and, thus, shifting off their posts and stem walls in the event of seismic disturbances, ground or dwelling vibrations, severe winds, or the impact of objects striking the home.

To this end, the present invention provides a support mechanism for a series of support units which are principally identical. The support units within the footing are sufficiently strong enough whereby a series of the same units, properly positioned engage the entire structural system holding the home up. Such a system of support, simultaneous to bracing adjacent girders, also achieves the firm abutment of the post ground connection, producing a unitized effect to the entire crawl space home.

A fabric formed footing has a column retainer assembly with a post socket and a post socket base. The column retainer assembly is a rigid structural member. A base plate is connected to the post socket. The base plate has a base plate underside opposing a base plate top surface. The base plate is connected to the post socket at the base plate top surface. A moment leg is connected to the base plate. The moment leg is connected to the base plate underside. The moment leg has a moment leg horizontal section, a moment leg vertical section, and a bend between the moment leg horizontal section and the moment leg vertical section. The moment leg vertical section is the portion of the moment leg that is connected to the base plate underside.

The base plate opening is formed on the base plate between the post socket and an edge of the base plate. Optionally, the fabric formed footing also has a post socket base periphery, weld connecting the column retainer assembly to the base plate. A post socket opening edge can be formed at an upper edge of the column retainer assembly. The post socket opening edge can be configured to receive a structural post. The ribs connect the column retainer assembly to the base plate. The ribs are welded between the column retainer assembly and the base plate. The ribs are rigid and made of metal. A bag form retainer is connected to a post socket sidewall of the post socket. The bag form retainer is adapted to receive a fabric bag. The fabric bag is configured to retain wet concrete. The post socket sidewall is rectangular. The post socket sidewall further includes a through bolt opening.

Optionally, a plastic water bag is mounted over the fabric bag, wherein the plastic water bag has drain openings that control seepage of water into the fabric bag for curing concrete in the fabric bag, wherein the fabric bag has a porous upper surface.

The footing replacement is made as a front section and a rear section. The front section connects to the rear section at a left connecting flange and a right connecting flange. A left front connecting flange is formed on the front section, and a right front connecting flange is formed on the front section.

A left rear connecting flange is formed on the rear section, and a right rear connecting flange is formed on the rear section. The left front connecting flange connects to the left rear connecting flange, and the right front connecting flange connects to the right rear connecting flange. The front section can be a front half section and the rear section can be a rear half section. A gasket can be placed between the front section on the rear section to provide a watertight seal between the sections.

Figure 1:
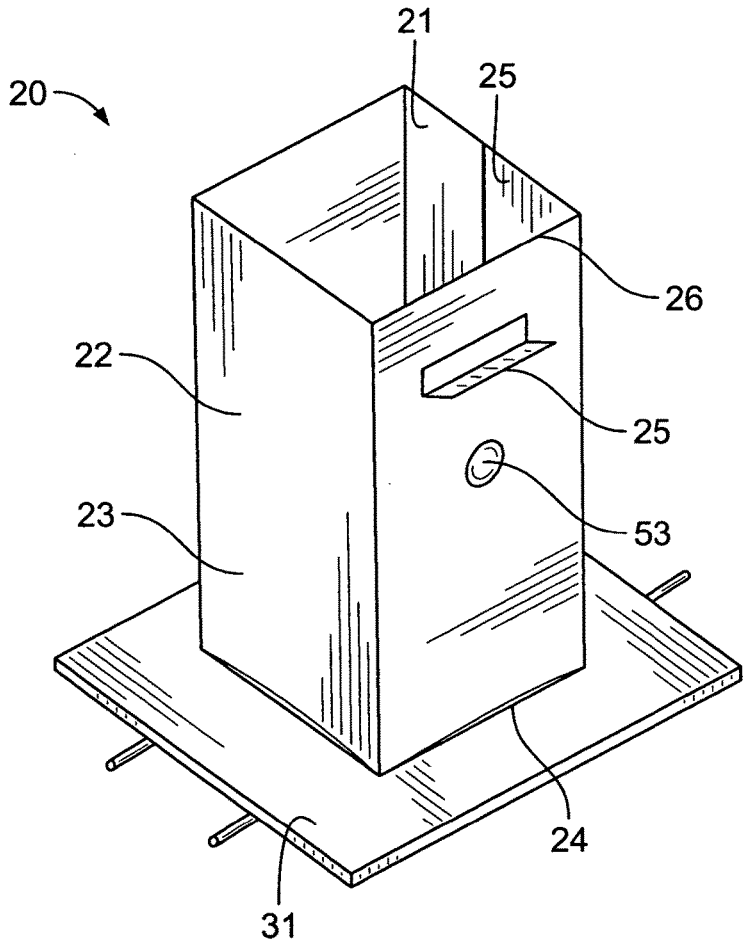
FIG. 1 is a perspective view of the present invention.

The following call out list of elements can be useful guide in referencing the elements of the drawings.

20 Column Retainer
21 Post Socket
22 Post Socket Sidewall
23 Post Socket Base
24 Post Socket Base Periphery Weld
25 Bag Form Retainer
26 Post Socket Opening Edge
31 Base Plate
32 Base Plate Underside
33 Base Plate Top Surface
34 Base Plate Opening
40 Moment Leg
41 Vertical Section
42 Bend
43 Horizontal Section
51 Ribs
52 Fabric Bag
53 Through Bolt Opening
54 Post
55 Foundation Attachment Bag
61 Dry Concrete Mix
62 Plastic Water Bag
63 Plastic Water Bag Openings
64 Concrete Filling Port
71 Front Half Section
72 Rear Half Section
73 Right Front Connecting Flange
74 Right Rear Connecting Flange
75 Left Front Connecting Flange
76 Left Rear Connecting Flange
77 Right Connecting Plate
78 Left Connecting Plate
80 Liner
81 Gasket

DETAILED DESCRIPTION OF THE PREFERRED EMBODIMENT

The present invention is a foundation pier that can be structural steel shop fabricated in accordance with common code of standard practices for steel buildings and bridges. Typical structural steel welding is used to connect the members. When fabricating the foundation pier, standard structural steel techniques are used including protecting dissimilar metals from galvanic corrosion, providing washers on all heads and nuts bearing on wood. All nuts are drawn tight and upset threads of permanent connections to prevent loosening. Typically, beveled washers can be used where bearing is on sloped surfaces. All metal should be cleaned of rust, dirt grease and other debris before painting or metal coating such as metallized zinc spray.

The footing has a column retainer assembly 20 having a post socket 21. The column retainer can be made with steel plate of quarter inch thickness. The column retainer 20 can be supported by ribs 51 of ⅜ inch thickness. A through bolt opening 53 of ¾ inch diameter can be formed in the post socket sidewall 22. The post socket 21 is formed of four post socket sidewalls 22. A wooden post can be inserted into the post socket 21 and secured by one or more bolts.

The foundation pier also has a bag form retainer 25 that is loaded to a post socket side wall 22 of the post socket 21. The post socket 21 has a post socket opening 25 that can be square or rectangular and include a post socket opening edge 26. The post socket 21 is welded to the base plate 31 at a post socket base 23 along a post socket base periphery weld 24. The post socket base 23 is coplanar with the base plate 31. The base plate 31 optionally includes a base plate opening 34 for securing to concrete. The post socket 21 optionally has a cushion pad such as an elastomeric building support pad. The post socket 21 optionally has an opening such as a drain opening for example to allow for drainage before installation.

The base plate 31 can be square and 1'×1' in dimensions for a total surface area of 144 in.$^2$ The base plate 31 has a base plate underside 32 and a base plate top surface 33. The post socket 21 is welded to the base plate top surface 33 and the moment leg 40 is welded to the base plate underside 32. The moment leg 40 has a moment leg vertical section 41 terminating at a bend 42 and continuing with a moment leg horizontal section 43. The moment leg vertical section 41 is perpendicular to the moment leg horizontal section 43. Automatic welding machines can provide high tolerance welding and high uniformity in product output.

The form bag 52 is attached to the bag form retainer 25. The form bag retainer 25 can secured to the form bag 52 by straps, rope or other connectors. Wet concrete can be pumped into the bag after the post is secured, or dry concrete can be added to the form bag 52 without first mixing with water. The ribs 51, formed as triangular supports, can reinforce the connection between the base plate 31 and the post socket 21. The form bag 52 is preferably made of a fabric material such as a plastic woven fabric. The form bag 52 can be formed from a heat sealed interface, or can be stitched together. Preferably, the form bag 52 has breathable water and air permeable openings substantially along the external periphery of the form bag 52.

In the best mode, the bag 52 has a porous top surface and the bag can receive a dry concrete mix 61. The user cuts off the 4×4 post preferably after installing a temporary structural support. Nominal size 4×4 can be 3.5"×3.5" in actual size or other actual size. The 4×4 post can be cut with a reciprocating saw for example. The user can then insert the freshly cut lower post end into the upward facing post socket. The post socket receives the freshly cut lower post end and has a bag retaining means. The bag is attached to the bag retaining means and can then be filled up with a dry concrete mix 61. A variety of different dry concrete mixes are available, some of which may have fiberglass reinforcement or wire reinforcement. Once the bag is filled up and secured to the bag retaining means, a user can add water to the top surface of the bag through a garden hose. The selection of the dry concrete mix 61 should be a quick setting concrete that can harden without mixing. The no mix concrete is preferred because the water can then flow through the porous top surface through the dry concrete mix 61 and the concrete mix can cure without mixing.

Optionally, the measurement of the amount of water can be simplified by adding a disc-shaped sponge or other annular water retaining member on top of the porous top surface. The bag could have a built in annular retaining water member, such as a fillable plastic water bag that is filled to a certain height, or a rim that retains water. In the case of a plastic water bag 62, the plastic water bag could be mounted over the fabric bag. If the fabric bag includes a plastic water bag over the porous top surface, the plastic water bag can have pre-sized openings 63 on it that are openable by pulling away a seal. The seal can be a self-adhesive plastic strip. This way, the user can simply fill up the bag, pull off the seal and wait for the plastic water bag to slowly drain into the dry concrete mix 61. The instructions can tell the user to fill up the plastic bag multiple times, such as two or three times, within a certain number of minutes.

Concrete filling port 64 can be added to the fabric bag 52 to allow pumping in of dry or wet concrete through a concrete pumping tube. An end of the tube that exudes concrete can be attached to the concrete filling port 64 that is formed as a one-way valve. The one-way valve can be a valve for regulating fluid flow such as dry concrete or wet concrete.

Stitching the fabric bag 52 to a foundation attachment bag 55 can allow for easier attachment of the fabric bag 52 over an existing foundation footing. The foundation attachment bag 55 can have a drawstring for an opening of the foundation attachment bag 55 to connect to Optionally, the fabric bag 52 can be secured to the foundation attachment bag 55 a cord or cable.

Figure 5:
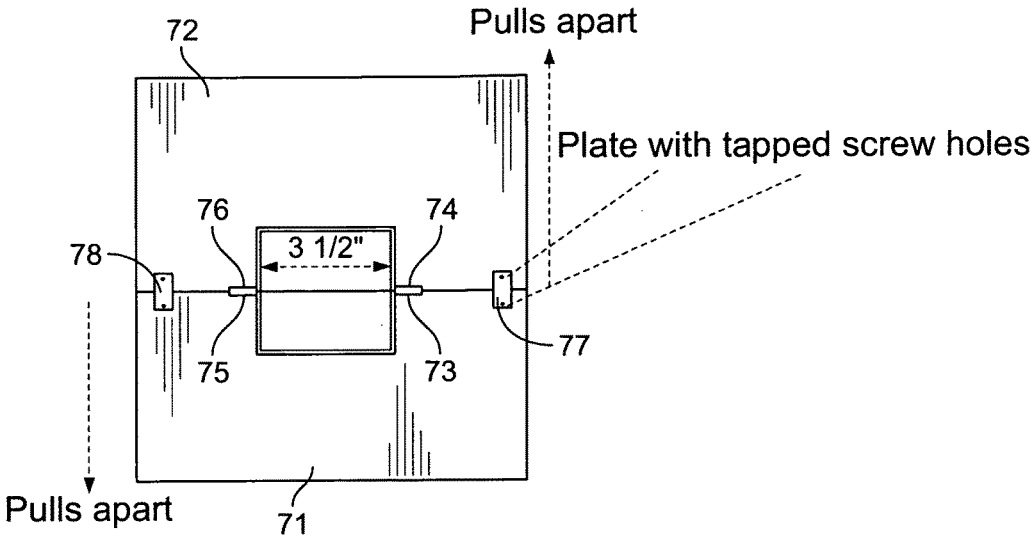
FIG. 5 is a top view of the present invention with a break for installation from the side.
Figure 6:
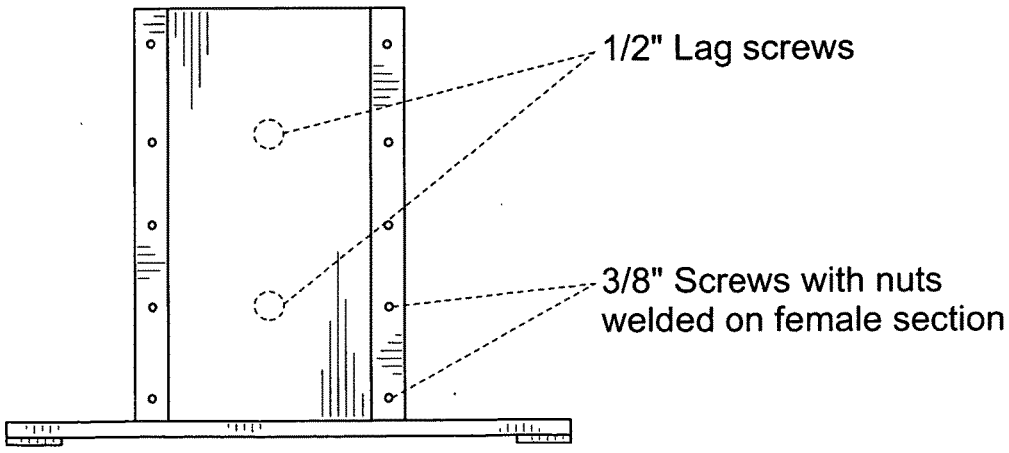
FIG. 6 is a front view of the present invention with a break for installation from the side.

As seen in FIG. 5, the footing replacement is not necessarily made in an integral one piece construction, but can have a front section and a rear section such as by being made in a front half section 71 and a rear half section 72. The front half section 71 includes a right front connecting flange 73 and a left front connecting flange 75. The right front connecting flange 73 connects to the right rear connecting flange 74 with bolts. Similarly, the left front connecting flange 75 bolts to the left rear connecting flange 76. Since all of the bolts lineup, the footing replacement can have a bisecting plane of symmetry to allow a user to first attach the first section which is the front half section, and then the user can attach the second section which is the rear half section that connects to the front half section.

Figure 7:
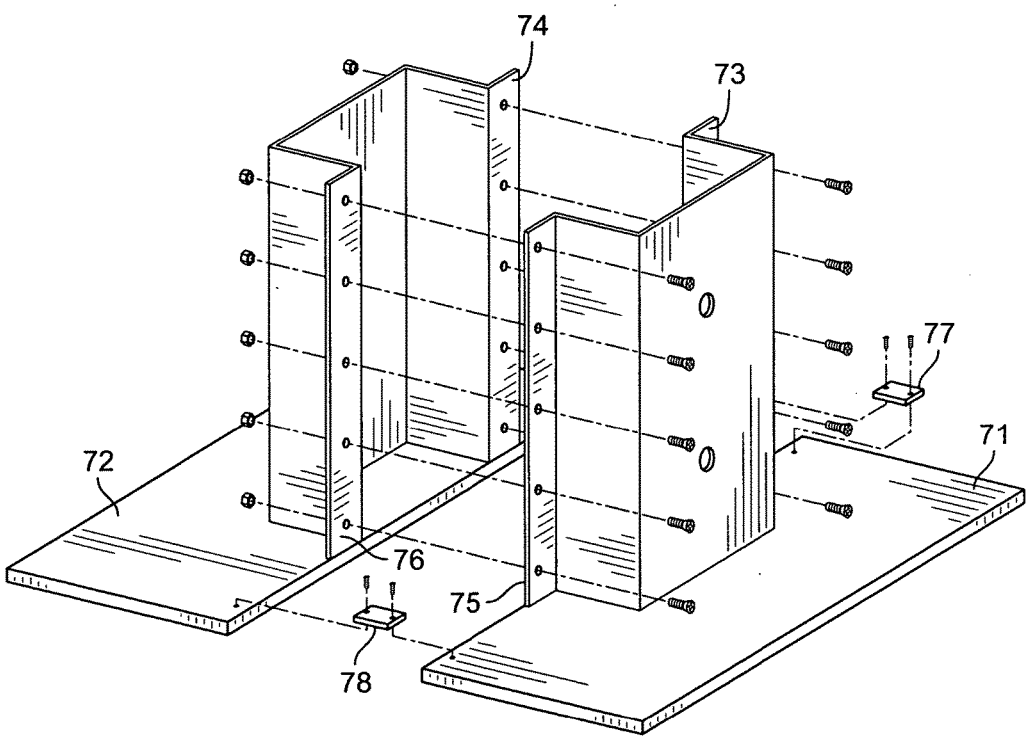
FIG. 7 is an exploded view of the present invention.
Figure 8:
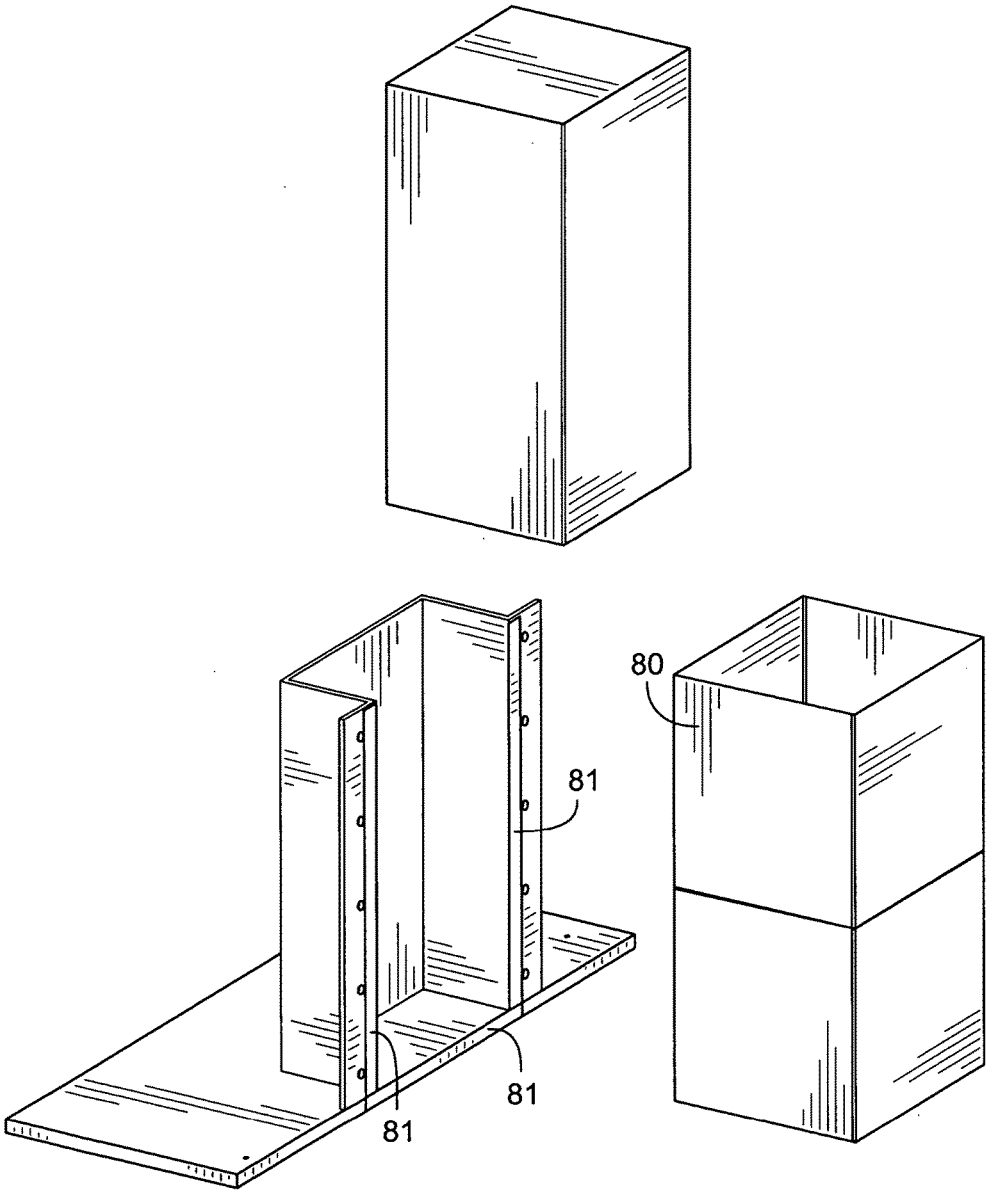
FIG. 8 is exploded view the present invention showing a gasket and a liner.

A liner 80 such as a sleeve can fit between the front half section 71 and the rear half section 72. The liner 80 can be made of a plastic sheath formed as a plastic bag. The liner 80 can be in the shape of a rectangular prism as shown in FIG. 7 and can be elongated as necessary for receiving a lower end of a support post. The liner 80 can be as long or as short as necessary and does not need to rise to the full height of the footing replacement, although it preferably does.

Figure 2:
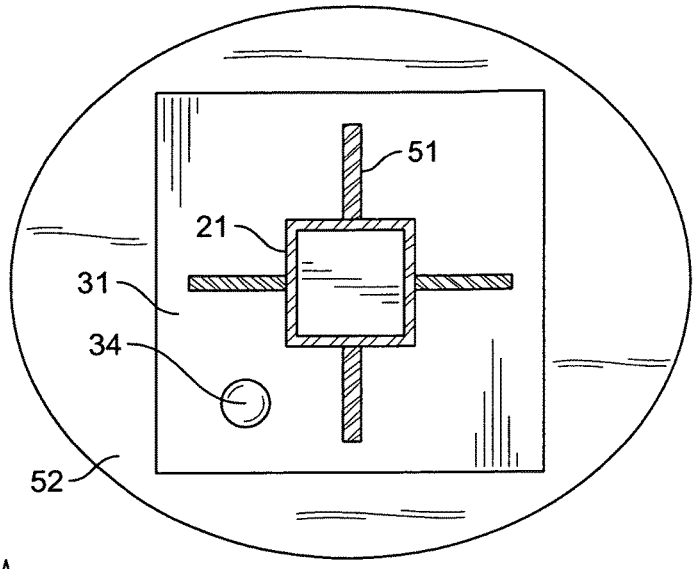
FIG. 2 is a top view of the present invention when the fabric form bag is beginning to fill with concrete.
Figure 3:
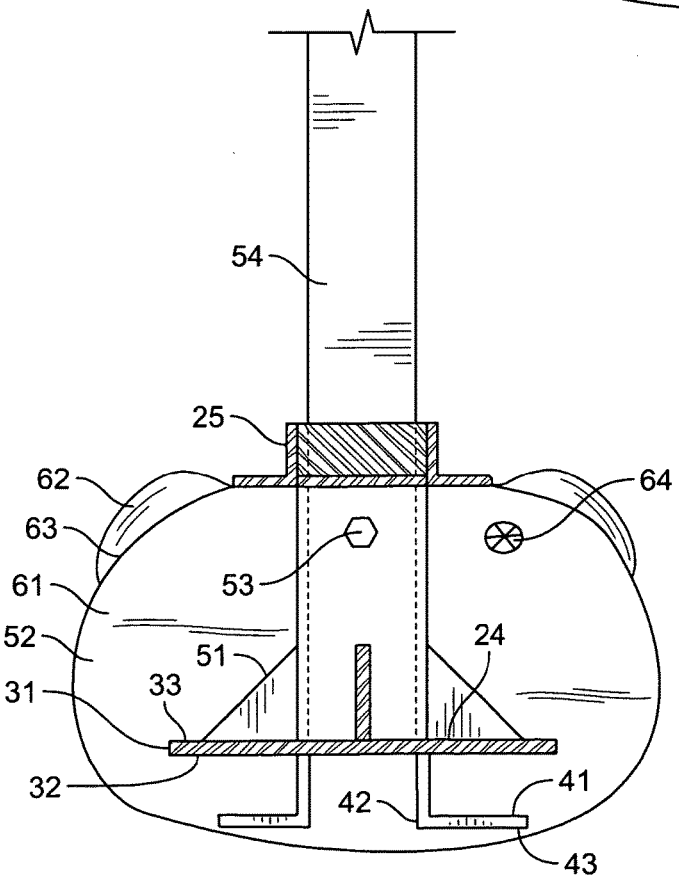
FIG. 3 is a side view of the present invention when the fabric form bag is beginning to fill with concrete.
Figure 4:
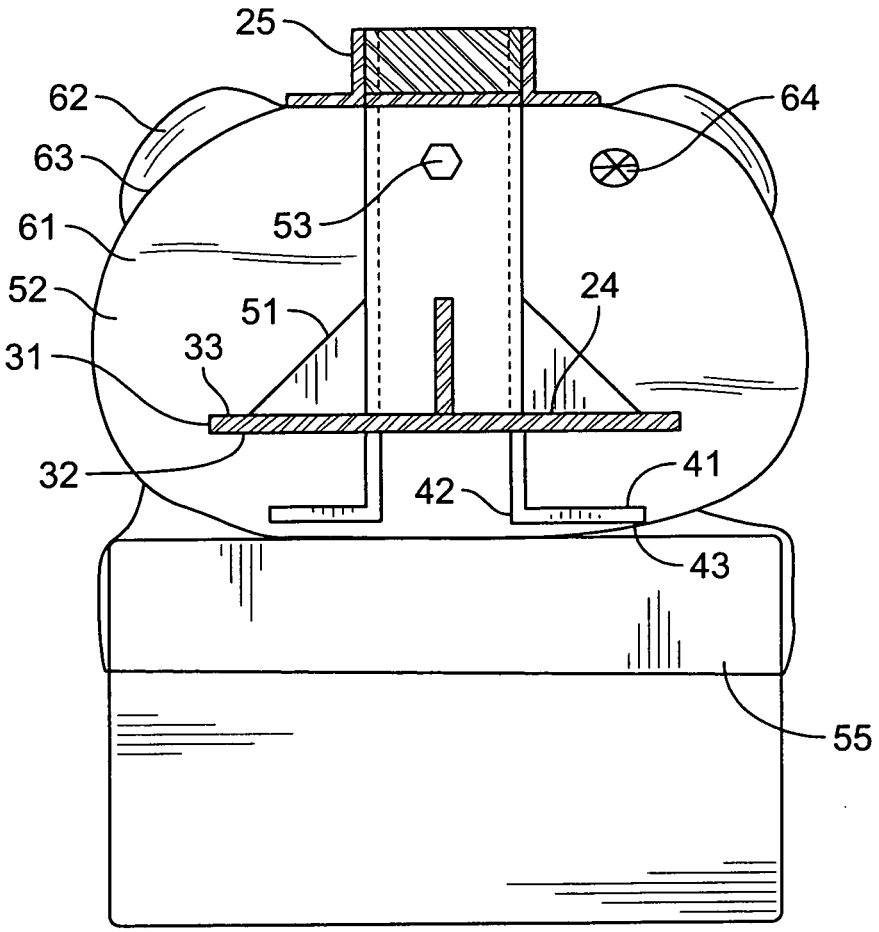
FIG. 4 is a side view showing the attachment of the foundation attachment bag 55 when the fabric form bag is beginning to fill with concrete.
Figure 9:
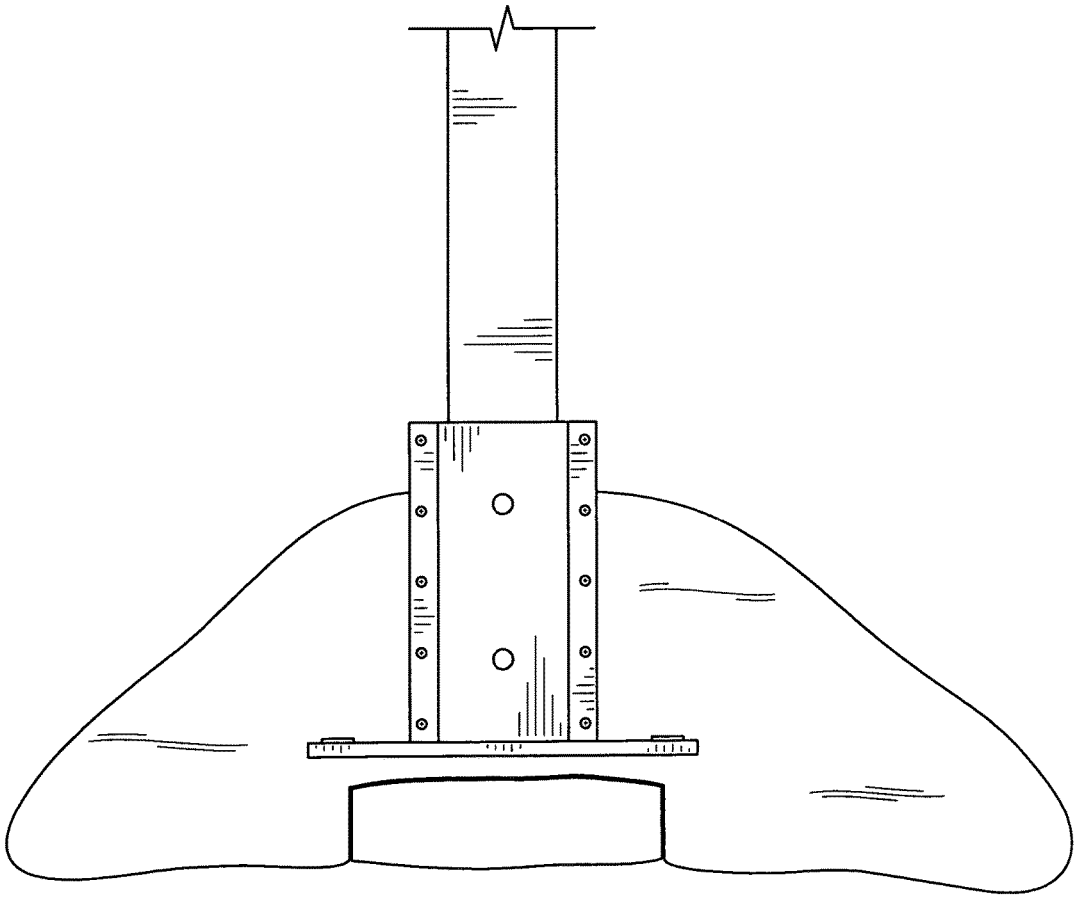
FIG. 9 shows the fabric form bag completely filled with concrete.

Additionally and alternatively, a gasket 81 can fit between the right front connecting flange 73 and the right rear connecting flange 74. The gasket 81 can be a polypropylene seal for example. The gasket 81 could also be formed by making the liner 79 with a pair of protruding wings 179 that are sandwiched between the right front connecting flange 73 and the right rear connecting flange 74. The waterproof gasket can be made of three strips to form a U-shaped gasket. In FIGS. 2-4, the fabric form bag is beginning to fill with concrete, and FIG. 9 shows the fabric form bag completely filled with concrete. After the fabric form bag is completely filled with concrete, the fabric form bag conforms to irregularities on the ground.

The invention claimed is:

1. A footing replacement for retrofitting a column support comprising:

a column retainer assembly with a post socket and a post socket base, wherein the column retainer assembly is a rigid structural member, wherein the column retainer assembly is configured to be retrofitted to a pre-existing structural column;

a base plate connected to the post socket, wherein the base plate has a base plate underside opposing a base plate top surface, wherein the base plate is connected to the post socket at the base plate top surface;

a moment leg connected to the base plate, wherein the moment leg is connected to the base plate underside, wherein the moment leg has a moment leg horizontal section, a moment leg vertical section, and a bend between the moment leg horizontal section and the moment leg vertical section, wherein the moment leg vertical section is the portion of the moment leg that is connected to the base plate underside;

a base plate opening formed on the base plate, wherein the base plate opening is formed between the post socket and an edge of the base plate;

a post socket base periphery weld connecting the column retainer assembly to the base plate;

a post socket opening edge formed at an upper edge of the column retainer assembly, wherein the post socket opening edge is configured to receive a post;

a bag form retainer connected to a post socket sidewall of the post socket, wherein the bag form retainer is adapted to receive a fabric bag, wherein the fabric bag is configured to retain concrete, wherein the fabric bag conforms to the shape of a ground surface when filled with concrete; and wherein the footing replacement is configured to be installed under a crawlspace of a home without moving or lifting the home.

2. The footing replacement for retrofitting a column support of claim 1, further comprising: ribs connecting the column retainer assembly to the base plate, wherein the ribs are welded between the column retainer assembly and the base plate, wherein the ribs are rigid and made of metal.

3. The footing replacement for retrofitting a column support of claim 1, wherein the post socket sidewall is rectangular.

4. The footing replacement for retrofitting a column support of claim 1, wherein the post socket sidewall further includes a through bolt opening.

5. The footing replacement for retrofitting a column support of claim 1, wherein a plastic water bag is mounted over the fabric bag, wherein the plastic water bag has drain openings that control seepage of water into the fabric bag for curing dry concrete in the fabric bag, wherein the fabric bag has a porous upper surface.

6. The footing replacement for retrofitting a column support of claim 1, wherein the footing replacement is made as a front section and a rear section, wherein the front section connects to the rear section at a left connecting flange and a right connecting flange, wherein a left front connecting flange is formed on the front section, wherein a right front connecting flange is formed on the front section, wherein a left rear connecting flange is formed on the rear section, wherein a right rear connecting flange is formed on the rear section, wherein the left front connecting flange connects to the left rear connecting flange, wherein the right front connecting flange connects to the right rear connecting flange.

7. The footing replacement for retrofitting a column support of claim 6, wherein the front section is a front half section and the rear section is a rear half section.

8. The footing replacement for retrofitting a column support of claim 7, wherein a gasket provides a waterproof seal between the front half section and the rear half section.

* * * * *